US006818143B2

(12) United States Patent
Iyengar

(10) Patent No.: US 6,818,143 B2
(45) Date of Patent: Nov. 16, 2004

(54) DURABLE MAGNETORHEOLOGICAL FLUID

(75) Inventor: Vardarajan R. Iyengar, Macomb, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/354,940

(22) Filed: Jan. 29, 2003

(65) Prior Publication Data

US 2003/0209687 A1 Nov. 13, 2003

Related U.S. Application Data

(63) Continuation-in-part of application No. 09/737,293, filed on Dec. 14, 2000, now Pat. No. 6,547,983.

(60) Provisional application No. 60/195,570, filed on Apr. 7, 2000.

(51) Int. Cl.[7] ..... H01F 1/44

(52) U.S. Cl. ..... 252/62.52

(58) Field of Search ..... 252/62.52

(56) References Cited

U.S. PATENT DOCUMENTS

| | | | | |
|---|---|---|---|---|
| 2,575,360 A | | 11/1951 | Rabinow | |
| 2,772,761 A | * | 12/1956 | Janson | 192/21.5 |
| 4,992,190 A | | 2/1991 | Shtarkman | |
| 5,167,850 A | | 12/1992 | Shtarkman | |
| 5,354,488 A | | 10/1994 | Shtarkman et al. | |
| 5,382,373 A | | 1/1995 | Carlson | |
| 5,518,639 A | | 5/1996 | Luk | |
| 5,578,238 A | | 11/1996 | Weiss | |
| 5,599,474 A | | 2/1997 | Weiss | |
| 5,645,752 A | | 7/1997 | Weiss | |
| 5,667,715 A | | 9/1997 | Foister | |
| 5,670,077 A | | 9/1997 | Carlson | |
| 5,683,615 A | | 11/1997 | Munoz | |
| 5,705,085 A | | 1/1998 | Munoz et al. | |
| 5,900,184 A | | 5/1999 | Weiss | |
| 5,906,767 A | | 5/1999 | Karol | |
| 5,984,056 A | | 11/1999 | Agnihotri | |
| 5,985,168 A | | 11/1999 | Phule | |
| 6,009,982 A | | 1/2000 | Agnihotri | |
| 6,027,664 A | | 2/2000 | Weiss | |
| 6,149,832 A | | 11/2000 | Foister | |
| 6,203,717 B1 | * | 3/2001 | Munoz et al. | 252/62.52 |
| 6,395,193 B1 | * | 5/2002 | Kintz et al. | 252/62.52 |
| 6,451,219 B1 | | 9/2002 | Iyengar et al. | |
| 6,547,983 B2 | * | 4/2003 | Iyengar | 252/62.52 |
| 6,592,772 B2 | * | 7/2003 | Foister et al. | 252/62.52 |
| 6,599,439 B2 | * | 7/2003 | Iyengar et al. | 252/62.52 |
| 6,638,443 B2 | * | 10/2003 | Iyengar et al. | 252/62.52 |

* cited by examiner

*Primary Examiner*—C. Melissa Koslow
(74) *Attorney, Agent, or Firm*—Michael D. Smith

(57) ABSTRACT

A durable magnetorheological fluid for use in a vibration dampening device is described. The MR fluid includes magnetizable particles having a particle size less than about 25 microns, a carrier fluid, a thixotropic agent, and a lubricative additive. The carrier fluid includes a polyalpha-olefin and a plasticizer. The lubricative additive has a particle size equal to or less than 10 microns such that the ability of the additive to lubricate the magnetizable particles is optimized. The lubricative additive includes at least one of polytetrafluoroethylene, graphite, and molybdenum disulfide.

48 Claims, No Drawings

DURABLE MAGNETORHEOLOGICAL FLUID

RELATED APPLICATIONS

This application is a continuation-in-part of U.S. patent application Ser. No. 09/737,293, filed on Dec. 14, 2000, and issued as U.S. Pat. No. 6,547,983 on Apr. 15,2003 which claims benefit of 60/195,570 filed on Apr. 7, 2000.

TECHNICAL FIELD

The present invention is related to a durable magnetorheological (MR) fluid having improved performance upon exposure to a magnetic field.

BACKGROUND OF THE INVENTION

Magnetorheological (MR) fluids are substances that exhibit the rather unique property of being able to reversibly change their apparent viscosity through the application of a magnetic field. For a MR fluid, the apparent viscosity, and related flow characteristics of the fluid, can be varied by controlling the applied magnetic field. These fluids have wide application in vibration dampening devices such as, for example, shock absorbers, vibration dampers, force/torque transfer (clutch) devices, and the like, and especially in systems in which variable control of the applied dampening/force is desirable.

Generally, MR fluids are suspensions of magnetizable particles in a carrier fluid. The particles are typically selected from iron, nickel, cobalt, and their magnetizable alloys. The carrier fluid is typically selected from mineral oil, synthetic hydrocarbon, water, silicone oil, esterified fatty acid or other suitable organic liquids. It is known that, over time, the carrier fluid may cause any seals associated with the vibration dampening device to shrink. Therefore, the carrier fluid is somewhat detrimental to the vibration dampening device in that it causes the seals to degrade over time and seal material is lost. The MR fluids of the prior art have not been able to combat this seal degradation.

MR fluids generally also further include a thickener, i.e., a thixotropic agent, to control settling, a phosphorus- or sulfur- containing additive to inhibit wear, and an organomolybdenum additive to inhibit friction. A surfactant may also be added to promote dispersability of the particles in the suspension.

The anti-wear additives used in prior art MR fluids have generally been selected from well-known anti-wear additives used in, for example, engine lubricants. These include thiophosphorus additives such as zinc dialkyl dithiophosphate (ZDDP). U.S. Pat. No. 5,683,615, for instance, describes a MR fluid comprising magnetic-responsive particles, a carrier fluid and at least one thiophosphorus or thiocarbamate; and U.S. Pat. No. 5,906,767 describes a MR fluid comprising magnetic-responsive particles, a carrier fluid and at least one phosphorus additive. Neither patent, however, discloses or suggests the use of a lubricative additive, such as polytetrafluoroethylene, graphite, and/or molybdenum disulfide, having a particle size equal to or less than 10 microns such that the additive can optimally lubricate the magnetizable particles and inhibit wear.

The anti-friction additives used in prior art MR fluids have also been generally selected from well-known organomolybdenum compounds used as anti-friction additives in engine lubricants. For example, U.S. Pat. No. 5,705,085 describes a MR fluid that includes magnetic-responsive particles, a carrier fluid and an organomolybdenum; and U.S. Pat. No. 5,683,615 also describes the use of the same organomolybdenum compounds in the MR fluids disclosed. Neither patent, however, discloses or suggests the use of a lubricative additive, such as polytetrafluoroethylene, graphite, and/or molybdenum disulfide, having a particle size equal to or less than 10 microns such that the additive can optimally lubricate the magnetizable particles and inhibit friction.

Furthermore, the anti-wear and anti-friction additives commonly used in prior art MR fluids such as ZDDP and organomolybdenum compounds pose environmental hazards due to the presence of heavy metals. Therefore, more environmentally friendly anti-wear and anti-friction additives are preferred, but as yet, have not been found.

Due to the deficiencies in the MR fluids of the prior art, including those described above, it is desirable to provide a MR fluid that is durable, that combats shrinkage and degradation of seals, and that substantially replaces the phosphorus- and sulfur-containing anti-wear additives and the organomolybdenum-based anti-friction additives found in prior art MR fluids.

SUMMARY OF THE INVENTION

The subject invention provides a durable MR fluid. The MR fluid includes magnetizable particles, a carrier fluid, a thixotropic agent, and a lubricative additive. More specifically, the magnetizable particles have a particle size less than about 25 microns, and the carrier fluid includes a polyalphaolefin and a plasticizer. The lubricative additive includes at least one of polytetrafluoroethylene, graphite, and molybdenum disulfide. Furthermore, the additive has a particle size equal to or less than 10 microns such that the ability of the additive to lubricate the magnetizable particles is optimized.

The MR fluid of the subject invention has anti-wear and anti-friction properties, but does not contain the heavy metals known in the prior art to pose environmental hazards. The lubricative additive gives the MR fluid of the subject invention its anti-wear and anti-friction properties. Therefore, the lubricative additive substantially replaces the phosphorus-based anti-wear additives and the organomolybdenum-based anti-friction additives found in prior art MR fluids. The lubricative additive inhibits surface-to-surface contact and scuffing within a vibration dampening device that utilizes the MR fluid while providing reliable lubrication under boundary lubrication conditions. Because the lubricative additive has a particle size equal to or less than 10 microns, the additive is more easily incorporated into the carrier fluid, the additive can penetrate into the microscopic crevices of the vibration dampening device, and lubrication of the magnetizable particles is optimized.

The plasticizer utilized in the carrier fluid combats shrinkage and degradation of any seals in the vibration dampening devices that utilize the MR fluid of the subject invention. More specifically, it has been found that the plasticizer provides seal swell. That is, the incorporation of the plasticizer in the carrier fluid causes any seals in the vibration dampening device to swell thereby regulating the integrity of the seal, or seals, over time and insuring against the loss of any seal material that would normally result from wear.

DESCRIPTION OF THE PREFERRED EMBODIMENT

A durable magnetorheological (MR) fluid is disclosed. The MR fluid of the present invention is primarily used in a vibration dampening device such as a vibration damper and the like. The MR fluid includes magnetizable particles, a carrier fluid, a thixotropic agent, and a lubricative additive.

The MR fluid of the subject invention is durable in that the MR fluid performs acceptable in standard MR damper durability tests known to those skilled in the art. In one such durability test, an MR damper is filled with MR fluid and a side load of 100 Newtons is applied to the tube at the rod guide. With this side load applied to the tube, the MR fluid is 'durable' because there is (1) no significant rod seal leakage, (2) no significant gas cup seal leakage, and (3) no significant damping force variations.

The magnetizable particles present in the MR fluid have a particle size less than about 25 microns. Preferably, the magnetizable particles have a particle size less than about 10 microns, and most preferably less than about 5 microns. The magnetizable particles have a Rockwell hardness that varies. That is, in certain embodiments, the Rockwell B hardness of the magnetizable particles is at least 50, yet in other embodiments, the Rockwell B hardness of the magnetizable particles is less than 50. In embodiments where the Rockwell B hardness is at least 50, the hardness preferably ranges from a Rockwell B hardness of 50 to a Rockwell C hardness of 65.

In one embodiment, the magnetizable particles include iron. In a further embodiment, the magnetizable particles are selected from the group consisting of iron, iron oxide, iron nitride, iron carbide, reduced carbonyl iron, unreduced carbonyl iron, chromium dioxide, low carbon steel, silicon steel, nickel, cobalt, and combinations thereof. In yet a further embodiment of the subject invention, the magnetizable particles include unreduced carbonyl iron. In this embodiment, the unreduced carbonyl iron has a particle size less than about 5 microns and a Rockwell B hardness of at least 50. In even a further embodiment of the subject invention, the magnetizable particles include reduced carbonyl iron. In this embodiment, the reduced carbonyl iron has a particle size less than about 10 microns and a Rockwell B hardness less than 50. It is also possible that, in certain embodiments, the magnetizable particles include an iron alloy. In these embodiments where an iron alloy is present, the iron alloy includes iron and an element selected from the group consisting of aluminum, silicon, cobalt, nickel, vanadium, molybdenum, chromium, tungsten, manganese, copper, and combinations thereof.

In any embodiment, it is preferred that the magnetizable particles are present in the MR fluid in an amount from 30 to 93, more preferably from 60 to 80, parts by weight based on 100 parts by weight of the durable MR fluid.

Examples of preferred carbonyl irons include, but are not limited to, BASF grades HS, HL, HM, HF, and HQ, and International Specialty Products (ISP) grades S-3700, S-1640, and S-2701. A non-limiting example of a preferred iron-cobalt alloy is Carpenter Technology grade HYPERCO™.

Although pure iron is soft and ductile, the hardness of iron may be increased by the addition of small quantities of impurities such as nitrogen, carbon, and oxygen. For example, "soft-grade" reduced carbonyl iron such as BASF grade CM contains 0.008% carbon, less than 0.01% nitrogen, and 0.2% oxygen, whereas "hard-grade" unreduced carbonyl iron such as BASF grade HS contains 0.74% carbon, 0.78% nitrogen, and less than 0.5% oxygen.

The carrier fluid includes a polyalphaolefin (PAO) and a plasticizer. Preferably, the PAO is present in the MR fluid in an amount from 5 to 30, more preferably from 15 to 25 parts by weight based on 100 parts by weight of the durable MR fluid. Preferably, the plasticizer is present in the MR fluid in an amount from 2 to 25, more preferably from 3 to 10, parts by weight based on 100 parts by weight of the durable MR fluid.

In one embodiment of the subject invention, the PAO includes dodecene. In a further embodiment, the PAO is selected from the group consisting of monomers of decene, dimers of decene, trimers of decene, tetramers of decene, monomers of dodecene, dimers of dodecene, trimers of dodecene, tetramers of dodecene, and combinations thereof. In any embodiment of the subject invention, the carrier fluid may further include at least one of cycloparaffin oils, paraffin oils, natural fatty oils, mineral oils, polyphenylethers, synthetic cycloparaffin oils, synthetic paraffin oils, unsaturated hydrocarbon oils, silicone oils, silicone copolymers, synthetic hydrocarbon oils, and perfluorinated polyethers and esters and halogenated hydrocarbons. The most preferred PAO is a dimer of dodecene. Examples of preferred PAOs include, but are not limited to, Chevron Synfluid™ 2.5 (a dimer of 1-dodecene), Chevron Synfluid™ 2 (a dimer of decene), Chevron Synfluid™ 4 (a trimer of decene), Mobil PAO SHF 21 (a dimer of decene), Mobil PAO SHF 41 (a trimer of decene), and Amoco Durasyn™ 170.

In one embodiment of the subject invention, the plasticizer includes dioctyl sebacate. In a further embodiment, the plasticizer is selected from the group consisting of monobasic acid esters, dibasic acid esters, glycol esters, glycol ethers, silicate esters, neopentylpolyol esters, phosphate esters, polyesters, dioctyl sebacates, dioctyl adipates, mixed alkyl adipate diesters, polyol esters, and combinations thereof. The most preferred plasticizer is dioctyl sebacate. The plasticizer of the subject invention that is incorporated into the carrier fluid provides seal swell. Examples of suitable plasticizers include, but are not limited to, UNIFLEX™ DOS, UNIFLEX™ DOA, UNIFLEX™ 250 and UNIFLEX™ 207-D, all commercially available from Arizona Chemical.

As initially described above, the MR fluid includes the thixotropic agent. On one embodiment, the thixotropic agent includes fumed silica. In this embodiment, the fumed silica can be treated fumed silica or untreated fumed silica. If the thixotropic agent includes fumed silica, then it is preferred that the fumed silica has a surface area of between about 250 to 450, more preferred between about 300 to 400, $m^2/g$. In a further embodiment, the thixotropic agent is further defined as at least one of treated fumed silica and untreated fumed silica. That is, in this embodiment, the thixotropic agent can include treated fumed silica, untreated fumed silica, or both. The most preferred thixotropic agent is untreated fumed silica. Examples of untreated fumed silica include, but are not limited to, CAB-O-SIL® grades EH-5, HS-5, H-5 and MS-55, available from Cabot Corporation.

As an alternative to fumed silica, the thixotropic agent includes an organoclay. The organoclay is formed by the reaction of an organic cation with smectite clay. The organic cation is quaternary ammonium chloride. The most preferred organoclay is CLAYTONE® EM commercially available from Southern Clay Products, Inc. of Gonzales, Tex. A further preferred organoclay is GARAMITE® LS also available from Southern Clay Products. Although CLAYTONE® EM may be used independently in the thixotropic agent, it is preferred that, if GARAMITE® LS is used in the thixotropic agent, then it is used in combination with CLAYTONE® EM.

In any embodiment, it is preferred that the thixotropic agent is present in the MR fluid in an amount from 0.5 to 5, more preferably from 0.5 to 2, parts by weight based on 100 parts by weight of the durable MR fluid.

The MR fluid further includes the lubricative additive. The lubricative additive includes at least one of polytetrafluoroethylene (PTFE), graphite, and molybdenum disulfide. As such, the lubricative additive can include any combination of PTFE, graphite, and molybdenum disulfide. The additive has a particle size equal to or less than 10 microns. As a result, the ability of the additive to lubricate the magnetizable particles is optimized. To further optimize the ability of the additive to lubricate the magnetizable particles, it is preferred that the particle size of the additive is equal to or less than 5 microns. In the most preferred embodiment of the subject invention, the particle size of the lubricative additive is equal to or less than 1 micron. As such, the additive is colloidal and the ability of the lubricative additive to lubricate the magnetizable particles is even further optimized. For the purposes of the subject invention, colloidal is any median particle size that is equal to or less than 2–4 microns. More preferably, colloidal is any median particle size is equal to or less than 1 micron. To optimally lubricate the magnetizable particles, it is preferred that the lubricative additive have a particle size equal to or less than 10 microns, but a colloidal lubricative additive is most preferred. It is also preferred that the lubricative additive is a colloidal suspension where particles of the lubricative additive are equal to or less than 2–4 microns and are suspended in a liquid medium. With the colloidal suspension, the smaller the particles of the lubricative additive, the easier the particles are to suspend in the liquid medium, and the more available the particles are to provide lubrication by penetrating into tiny crevasses.

The additive, used individually or in combinations, imparts both anti-wear and anti-friction properties to the MR fluids of the present invention. As such, the lubricative additive of the present invention substantially replaces or reduce the use of known prior art additives such as ZDDP and organomolybdenum compounds. This lubricative additive further provides the MR fluid with extreme pressure and load carrying properties that can result in smoother operation of the vibration dampening device and extended life and reduced maintenance of the vibration dampening device. To accomplish this, it is preferred that the lubricative additive is present in an amount from 0.5 to 20, more preferably from 1 to 10, parts by weight based on 100 parts by weight of the durable MR fluid.

It is also preferred that the lubricative additive is dispersed in a non-aqueous medium compatible with the carrier fluid. Most lubricative additives are commercially available in such dispersed forms and this eases the incorporation of the additive into mixture with the carrier fluid. If the lubricative additive is dispersed in the non-aqueous medium, then it most preferred that the non-aqueous medium is selected from the group consisting of synthetic oils, petroleum oils, mineral oils, and combinations thereof.

In one embodiment of the subject invention, the lubricative additive is PTFE. PTFE is preferably a dispersion of fine particles in any convenient non-aqueous media, for example synthetic oil or mineral oil. For PTFE, the preferred particle size is less than 5 microns. Examples of PTFE lubricative additives include, but are not limited to, SLA 1612 and SLA 1614 which are commercially available from Acheson Colloids Company, A National Starch Company, of Port Huron, Mich. SLA 1612 has a median particle size less than 2 microns and SLA 1614 has a median particle size from 2 to 4 microns.

In a further embodiment, the lubricative additive is graphite. The graphite lubricative additive for use in the present invention is preferably a suspension of uniform colloidal graphite particles in a highly refined synthetic or petroleum oil. For graphite, the preferred particle size, average, is 0.5 microns such that the graphite is colloidal. An example of a graphite lubricative additive includes, but is not limited to, SLA 1275 which is also commercially available from Acheson Colloids Company.

In yet a further embodiment of the subject invention, the lubricative additive is molybdenum disulfide. The molybdenum disulfide lubricative additive for use in the present invention is preferably a stable dispersion of uniform microscopic molybdenum disulfide particles in a highly refined synthetic or petroleum oil concentrate. An example of a molybdenum disulfide lubricative additive includes, but is not limited to, SLA 1286 which is also commercially available from Acheson Colloids Company.

When used in combinations, it is preferred that the PTFE be used in each combination. For example, it is preferred that the SLA 1286 and/or the SLA 1275 be blended with the SLA 1614 for a combination PTFE-graphite and/or molybdenum disulfide product.

In one preferred MR fluid of the subject invention, the magnetizable particles include unreduced carbonyl iron having a particles size less than about 5 microns and a Rockwell B hardness of at least 50, the polyalphaolefin includes a dimer of dodecene and the plasticizer includes dioctyl sebacate, the thixotropic agent includes untreated fumed silica having a surface area of between about 330 to 430 $m^2/g$, and the lubricative additive includes at least one of polytetrafluoroethylene, graphite, and molybdenum disulfide. In this particular embodiment, the additive has a particle size equal to or less than 10 microns such that the ability of the lubricative additive to lubricate the unreduced carbonyl iron is optimized.

In a second preferred MR fluid of the subject invention, the magnetizable particles include reduced carbonyl iron having a particles size less than about 10 microns and a Rockwell B hardness less than 50, the polyalphaolefin includes dodecene and the plasticizer includes dioctyl sebacate, the thixotropic agent includes an organoclay, and the lubricative additive includes at least one of polytetrafluoroethylene, graphite, and molybdenum disulfide. In this particular embodiment, the additive has a particle size equal to or less than 10 microns such that the ability of the lubricative additive to lubricate the reduced carbonyl iron is optimized.

In all embodiment, the MR fluid may optionally include an anti-wear additive. The MR fluid may also optionally include an anti-friction additive. If included, the anti-wear additive is preferably zinc dialkyl dithiophosphate (ZDDP) and the anti-friction additive is preferably an organomolybdenum compound. The amount of each of these additives present in the MR fluid, is dependent upon the total weight of the PAO and the plasticizer, the primary liquid components. It is contemplated that the weight fraction of the anti-wear additive to the PAO and the plasticizer should be in the range of 0 to about 0.03 and the weight fraction of the anti-friction additive to the PAO and the plasticizer should be in the range of 0 to about 0.03. Examples of anti-wear agents include ZDDP such as available from Lubrizol Corporation (e.g., grades 1395 and 677A) and Ethyl Corporation (e.g., grades HiTEC™ 7197 and HiTEC™ 680). Examples of anti-friction agents include organomolybdenum compounds (MOLY) such as NAUGALUBE™ MOLYFM 2543 commercially available from C. K. Witco and MOLYVAN™ 855 available from R. T. Vanderbilt Company and alkyl amine oleates.

The following examples illustrating the formation of the MR fluid, as presented herein, are intended to illustrate and not limit the invention.

EXAMPLES

Example 1

The MR fluid of Example 1 was prepared by adding and reacting the following parts, by weight, unless otherwise indicated.

| Example 1 Component | Amount (grams) |
|---|---|
| Magnetizable Particles | 68.63 |
| Carrier Fluid - Polyalphaolefin | 20.53 |
| Carrier Fluid - Plasticizer | 5.70 |
| Thixotropic Agent A | 1.21 |
| Lubricative Additive | 3.93 |
| Total | 100.00 |

Example 2

The MR fluid of Example 2 was prepared by adding and reacting the following parts, by weight, unless otherwise indicated.

| Example 2 Component | Amount (grams) |
|---|---|
| Magnetizable Particles | 69.12 |
| Carrier Fluid - Polyalphaolefin | 21.16 |
| Carrier Fluid - Plasticizer | 5.93 |
| Thixotropic Agent A | 1.08 |
| Lubricative Additive A | 2.71 |
| Total | 100.00 |

Example 3

The MR fluid of Example 3 was prepared by adding and reacting the following parts, by weight, unless otherwise indicated.

| Example 3 Component | Amount (grams) |
|---|---|
| Magnetizable Particles | 69.20 |
| Carrier Fluid - Polyalphaolefin | 21.10 |
| Carrier Fluid - Plasticizer | 5.92 |
| Thixotropic Agent A | 1.08 |
| Lubricative Additive B | 2.70 |
| Total | 100.00 |

Example 4

The MR fluid of Example 4 was prepared by adding and reacting the following parts, by weight, unless otherwise indicated.

| Example 4 Component | Amount (grams) |
|---|---|
| Magnetizable Particles | 69.00 |
| Carrier Fluid - Polyalphaolefin | 19.52 |

-continued

| Example 4 Component | Amount (grams) |
|---|---|
| Carrier Fluid - Plasticizer | 5.48 |
| Thixotropic Agent A | 1.00 |
| Lubricative Additive A | 2.50 |
| Lubricative Additive B | 2.50 |
| Total | 100.00 |

Example 5 (Prophetic Example)

The MR fluid of Example 5 is to be prepared by adding and reacting the following parts, by weight, unless otherwise indicated.

| Example 5 Component | Amount (grams) |
|---|---|
| Magnetizable Particles | 69.00 |
| Carrier Fluid - Polyalphaolefin | 19.52 |
| Carrier Fluid - Plasticizer | 5.48 |
| Thixotropic Agent B | 1.00 |
| Lubricative Additive A | 2.50 |
| Lubricative Additive B | 2.50 |
| Total | 100.00 |

The components for Examples 1–5 are as follows:

the magnetizable particles are BASF Grade HS carbonyl iron;

the carrier fluid—polyalphaolefin is Chevron Synfluid™ 2.5;

the carrier fluid—plasticizer is UNIFLEX™ DOS;

the thixotropic agent A is CAB-O-SIL® Grade EH-5;

the thixotropic agent B is CLAYTONE® EM;

the lubricative additive A is SLA 1614; and the lubricative additive B is SLA 1275.

The MR fluid of Examples 1–4 were, and the MR fluid of Example 5 is to be, formulated as follows. For a 1 gallon batch, the liquid-type components (the carrier fluid, including PAO and dioctyl sebacate, and the lubricative additive) are first mixed together under low shear conditions of about 200 to about 500 rpm. The thixotropic agent is then added to the liquid components and mixed for an additional 20 minutes. Following this mixing step, the magnetizable particles, a powder in form, are slowly added while continuously mixing, and then mixing is continued for about 1 hour or until the magnetizable particles are thoroughly dispersed, whichever is greater. The MR fluid is then subjected to high shear mixing at about 2500 to about 3500 rpm for about 10 to about 30 minutes. For descriptive purposes only, in each of the Examples set forth above, the amount of the MR fluid has been scaled to 100.00 grams, but for 1 gallon batches, the amount of each component is increased proportionally.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A durable magnetorheological fluid comprising:

magnetizable particles having a particle size less than about 25 microns;

a carrier fluid comprising a polyalphaolefin and a plasticizer;

a thixotropic agent; and a lubricative additive comprising at least one of polytetrafluoroethylene, graphite, and molybdenum disulfide, wherein said lubricative additive has a particle size equal to or less than 10 microns such that the ability of said lubricative additive to lubricate said magnetizable particles is optimized.

2. A durable magnetorheological fluid as set forth in claim 1 wherein said magnetizable particles have a Rockwell B hardness of at least 50.

3. A durable magnetorheological fluid as set forth in claim 1 wherein said magnetizable particles have a Rockwell B hardness less than 50.

4. A durable magnetorheological fluid as set forth in claim 1 wherein said particle size of said magnetizable particles is less than about 10 microns.

5. A durable magnetorheological fluid as set forth in claim 1 wherein said magnetizable particles have a particle size less than about 5 microns.

6. A durable magnetorheological fluid as set forth in claim 1 wherein said magnetizable particles comprise iron.

7. A durable magnetorheological fluid as set forth in claim 1 wherein said magnetizable particles are selected from the group consisting of iron, iron oxide, iron nitride, iron carbide, reduced carbonyl iron, unreduced carbonyl iron, chromium dioxide, low carbon steel, silicon steel, nickel, cobalt, and combinations thereof.

8. A durable magnetorheological fluid as set forth in claim 1 wherein said magnetizable particles comprise unreduced carbonyl iron.

9. A durable magnetorheological fluid as set forth in claim 8 wherein said unreduced carbonyl iron has a particle size less than about 5 microns and a Rockwell B hardness of at least 50.

10. A durable magnetorheological fluid as set forth in claim 1 wherein said magnetizable particles comprise reduced carbonyl iron.

11. A durable magnetorheological fluid as set forth in claim 10 wherein said reduced carbonyl iron has a particle size less than about 10 microns and a Rockwell B hardness less than 50.

12. A durable magnetorheological fluid as set forth in claim 1 wherein said magnetizable particles comprise an iron alloy.

13. A durable magnetorheological fluid as set forth in claim 12 wherein said iron alloy comprises iron and an element selected from the group consisting of aluminum, silicon, cobalt, nickel, vanadium, molybdenum, chromium, tungsten, manganese, copper, and combinations thereof.

14. A durable magnetorheological fluid as set forth in claim 1 wherein said polyalphaolefin comprises dodecene.

15. A durable magnetorheological fluid as set forth in claim 1 wherein said polyalphaolefin is selected from the group consisting of monomers of decene, dimers of decene, trimers of decene, tetramers of decene, monomers of dodecene, dimers of dodecene, trimers of dodecene, tetramers of dodecene, and combinations thereof.

16. A durable magnetorheological fluid as set forth in claim 15 wherein said carrier fluid further comprises at least one of cycloparaffin oils, paraffin oils, natural fatty oils, mineral oils, polyphenylethers, synthetic cycloparaffin oils, synthetic paraffin oils, unsaturated hydrocarbon oils, silicone oils, silicone copolymers, synthetic hydrocarbon oils, and perfluorinated polyethers and esters and halogenated hydrocarbons.

17. A durable magnetorheological fluid as set forth in claim 1 wherein said plasticizer comprises dioctyl sebacate.

18. A durable magnetorheological fluid as set forth in claim 1 wherein said plasticizer is selected from the group consisting of monobasic acid esters, dibasic acid esters, glycol esters, glycol ethers, silicate esters, neopentylpolyol esters, phosphate esters, polyesters, dioctyl sebacates, dioctyl adipates, mixed alkyl adipate diesters, polyol esters, and combinations thereof.

19. A durable magnetorheological fluid as set forth in claim 1 wherein said polyalphaolefin comprises dodecene and said plasticizer comprises dioctyl sebacate.

20. A durable magnetorheological fluid as set forth in claim 1 wherein said thixotropic agent comprises fumed silica.

21. A durable magnetorheological fluid as set forth in claim 1 wherein said thixotropic agent is further defined as at least one of treated fumed silica and untreated fumed silica.

22. A durable magnetorheological fluid as set forth in claim 20 wherein said fumed silica has a surface area of between about 250 to 450 $m^2/g$.

23. A durable magnetorheological fluid as set forth in claim 20 wherein said fumed silica has a surface area of between about 300 to 400 $m^2/g$.

24. A durable magnetorheological fluid as set forth in claim 1 wherein said thixotropic agent comprises an organoclay.

25. A durable magnetorheological fluid as set forth in claim 24 wherein said organoclay is formed by the reaction of an organic cation with smectite clay.

26. A durable magnetorheological fluid as set forth in claim 25 wherein said organic cation is quaternary ammonium chloride.

27. A durable magnetorheological fluid as set forth in claim 1 wherein said lubricative additive is polytetrafluoroethylene.

28. A durable magnetorheological fluid as set forth in claim 1 wherein said lubricative additive is graphite.

29. A durable magnetorheological fluid as set forth in claim 1 wherein said lubricative additive is molybdenum disulfide.

30. A durable magnetorheological fluid as set forth in claim 1 wherein said lubricative additive is dispersed in a non-aqueous medium compatible with said carrier fluid.

31. A durable magnetorheological fluid as set forth in claim 30 wherein said non-aqueous medium is selected from the group consisting of synthetic oils, petroleum oils, mineral oils, and combinations thereof.

32. A durable magnetorheological fluid as set forth in claim 1 further comprising an anti-wear additive.

33. A durable magnetorheological fluid as set forth in claim 32 further comprising an anti-friction additive.

34. A durable magnetorheological fluid as set forth in claim 33 wherein said anti-wear additive is zinc dialkyl dithiophosphate and said anti-friction additive is an organomolybdenum compound.

35. A durable magnetorheological fluid as set forth in claim 1 wherein:

said magnetizable particles comprise unreduced carbonyl iron having a particles size less than about 5 microns and a Rockwell B hardness of at least 50;

said polyalphaolefin comprises dodecene and said plasticizer comprises dioctyl sebacate;

said thixotropic agent comprises untreated fumed silica having a surface area of between about 330 to 430 $m^2/g$; and said lubricative additive comprises at least one of polytetrafluoroethylene, graphite, and molybdenum disulfide, wherein said lubricative additive has a particle size equal to or less than 10 microns such that the ability of said lubricative additive to lubricate said unreduced carbonyl iron is optimized.

36. A durable magnetorheological fluid as set forth in claim 1 wherein:

said magnetizable particles comprise reduced carbonyl iron having a particles size less than about 10 microns and a Rockwell B hardness less than 50;

said polyalphaolefin comprises dodecene and said plasticizer comprises dioctyl sebacate;

said thixotropic agent comprises an organoclay; and said lubricative additive comprises at least one of polytetrafluoroethylene, graphite, and molybdenum disulfide, wherein said lubricative additive has a particle size equal to or less than 10 microns such that the ability of said lubricative additive to lubricate said reduced carbonyl iron is optimized.

37. A durable magnetorheological fluid as set forth in claim 1 wherein said magnetizable particles are present in an amount from 30 to 93 parts by weight based on 100 parts by weight of said durable magnetorheological fluid.

38. A durable magnetorheological fluid as set forth in claim 37 wherein said magnetizable particles are present in an amount from 60 to 80 parts by weight based on 100 parts by weight of said durable magnetorheological fluid.

39. A durable magnetorheological fluid as set forth in claim 1 wherein said polyalphaolefin is present in an amount from 5 to 30 parts by weight based on 100 parts by weight of said durable magnetorheological fluid.

40. A durable magnetorheological fluid as set forth in claim 39 wherein said polyalphaolefin is present in an amount from 15 to 25 parts by weight based on 100 parts by weight of said durable magnetorheological fluid.

41. A durable magnetorheological fluid as set forth in claim 1 wherein said plasticizer is present in an amount from 2 to 25 parts by weight based on 100 parts by weight of said durable magnetorheological fluid.

42. A durable magnetorheological fluid as set forth in claim 41 wherein said plasticizer is present in an amount from 3 to 10 parts by weight based on 100 parts by weight of said durable magnetorheological fluid.

43. A durable magnetorheological fluid as set forth in claim 1 wherein said thixotropic agent is present in an amount from 0.5 to 5 parts by weight based on 100 parts by weight of said durable magnetorheological fluid.

44. A durable magnetorheological fluid as set forth in claim 43 wherein said thixotropic agent is present in an amount from 0.5 to 2 parts by weight based on 100 parts by weight of said durable magnetorheological fluid.

45. A durable magnetorheological fluid as set forth in claim 1 wherein said lubricative additive is present in an amount from 0.5 to 20 parts by weight based on 100 parts by weight of said durable magnetorheological fluid.

46. A durable magnetorheological fluid as set forth in claim 45 wherein said lubricative additive is present in an amount from 1 to 10 parts by weight based on 100 parts by weight of said durable magnetorheological fluid.

47. A durable magnetorheological fluid as set forth in claim 1 wherein said particle size of said lubricative additive is equal to or less than 5 microns such that the ability of said lubricative additive to lubricate said magnetizable particles is optimized.

48. A durable magnetorheological fluid as set forth in claim 1 wherein said particle size of said lubricative additive is equal to or less than 1 micron such that said lubricative additive is colloidal and the ability of said lubricative additive to lubricate said magnetizable particles is optimized.

* * * * *